US005389015A

United States Patent [19]

Sasai et al.

[11] Patent Number: 5,389,015

[45] Date of Patent: Feb. 14, 1995

[54] CONNECTOR

[75] Inventors: Osamu Sasai; Masaji Suzuki, both of Yokkaichi, Japan

[73] Assignee: Sumitomo Wiring Systems, Ltd., Yokkaichi, Japan

[21] Appl. No.: 121,418

[22] Filed: Sep. 16, 1993

[30] Foreign Application Priority Data

Oct. 8, 1992 [JP] Japan ..... 4-076871[U]

[51] Int. Cl.[6] ..... H01R 13/436; H01R 13/627

[52] U.S. Cl. ..... 439/752; 439/555

[58] Field of Search ..... 439/752, 595, 555, 557, 439/554

[56] References Cited

U.S. PATENT DOCUMENTS 3,430,188 2/1969 Yokkaichi et al. ..... 439/555
3,989,343 11/1976 Lucius et al. ..... 439/557
3,998,518 12/1976 Mathe ..... 439/557
5,069,639 12/1991 Kodama et al. ..... 439/752
5,108,319 4/1992 Tsuji et al. ..... 439/752

*Primary Examiner*—Gary F. Paumen
*Attorney, Agent, or Firm*—Oliff & Berridge

[57] ABSTRACT

To prevent disengagement of a connector from a predetermined position after installation, while ensuring an easy installation, arm stoppers are connected to a retainer by strap-like connection portions. An engagement hole is provided at each of opposite sides of a connector body, and a locking arm is provided outwardly of the engagement hole. When the retainer is to be attached to the connector body, each arm stopper is inserted slightly into the engagement hole. In this condition, the locking arm can be flexed inwardly, and therefore the removal of the connector is simplified. After the connector is attached to a panel, the arm stopper is inserted deep into the engagement hole, and therefore the locking arm cannot be flexed inwardly, and a retaining pawl cannot be moved and the connector cannot be removed from the panel.

9 Claims, 6 Drawing Sheets

CONNECTOR

BACKGROUND OF THE INVENTION

This invention relates to a connector, and more particularly, to a connector for mounting on a panel.

One known connector of this type is shown in FIG. 10.

The connector 1 shown in FIG. 10 is a so-called door-waiting connector fixed to a body or a door of an automobile. Connector 1 includes at its front side a peripheral hood portion 2 for receiving a mating connector therein. Abutment support plates 2*a* are respectively formed on and extend perpendicularly from upper and lower faces of the peripheral hood portion 2 at the front end of the hood portion. When the peripheral hood portion 2 is inserted a predetermined distance through a mounting hole 3*a* formed through a body retaining plate 3, the abutment support plates 2*a* abut against the edge portion of the mounting hole 3*a*.

A flexible locking arm 2*b* extends from the inner edge of the abutment support plate 2*a* in the same direction as the direction of extension of the peripheral hood portion 2, and a retaining pawl $2b_1$ is formed on the outer surface of the locking arm 2*b* on the same side as the outer peripheral surface of the peripheral hood portion 2. The front portion of the retaining pawl $2b_1$ has a slanting surface $2b_{1a}$ slanting outwardly of the peripheral hood portion 2 toward the rear end of the retaining pawl. The rear end of the retaining pawl $2b_1$ has a vertical surface $2b_{1b}$ generally parallel to the abutment support plate 2*a*.

When the peripheral hood portion 2 of the connector 1 of this construction is inserted through the mounting hole 3*a* of the body retaining plate 3, the slanting surface $2b_{1a}$ of the retaining pawl $2b_1$ of each locking arm 2 is engaged with the inner edge of the mounting hole 3*a*, so that the locking arm 2 is flexed inwardly of the peripheral hood portion 2. When the peripheral hood portion 2 is further inserted, each abutment plate 2*a* abuts against the body retaining plate 3, and at the same time, the vertical surface $2b_{1b}$ of the retaining pawl passes past the mounting hole 3*a*, so that the locking arm 2 is restored into its initial configuration. In this condition, the vertical surface $2b_{1b}$ holds, together with the abutment support plate 2*a*, the body retaining plate 3 therebetween, and the connector 1 is fixedly retained in the mounting hole 3*a*.

The above conventional connector has an advantage that it can be easily mounted on the body retaining plate 3, but also has the following problems.

When a mating connector 4 is to be inserted into the peripheral hood portion 2 for connection purposes after the connector 1 is fixedly retained in the mounting hole, a sufficient space for effecting this operation is, in most cases, not available. Therefore, it is impossible to insert the mating connector 4 into the peripheral hood portion 2 from the front side, and therefore it is intended to insert the mating connector into the peripheral hood portion 2 somewhat from the upper side or the lower side. At this time, upon abutment of the front end of the connector 4 against the front end of the locking arm 2*b*, the locking arm 2*b* is flexed inwardly of the peripheral hood portion 2, as shown in FIG. 11(A), so that the engagement of the locking pawl $2b_1$ is released. As a result, the connector 1 is disengaged from the mounting hole 3*a*, as shown in FIG. 11(B). Particularly when the connector 1 is installed on the door in such a manner that it is directed from the inner side toward the outer side, the connector 1 falls in the interior of the door, and cannot easily be removed.

SUMMARY OF THE INVENTION

The present invention has been made in view of the above problem, and an object of the invention is to provide a connector of the type that can be easily installed, and also is prevented from being displaced from a predetermined position after it is installed.

To achieve the above object, according to the present invention, there is provided a connector adapted to be inserted through a mounting hole in a fixed panel member and lockingly held on an edge portion of the mounting hole by a locking arm formed on a peripheral portion of the connector. The connector includes an arm stopper that is connected by a flexible connection portion to a retainer that retains metal terminals, held by the connector, in a double-locking manner. The arm stopper is movable into and out of a space portion formed in a flexing direction of the locking arm.

In the present invention, the retainer is attached to the connector to achieve a double-lock or a complete lock of the metal terminals, and the arm stopper connected to the retainer by the connection portion is movable into and out of the space portion formed in the flexing direction of the locking arm. The connector is installed in the mounting hole, with the arm stopper disposed out of the space portion, and the arm stopper is inserted into the space portion, whereupon the locking arm cannot be flexed, so that the connector cannot be substantially removed from the mounting hole. If necessary, the arm stopper is moved out of the space portion, and the locking arm is flexible in the space portion to enable the connector to be removed from the mounting hole. The arm stopper is connected to the retainer by the connection portion and therefore is connected to the connector when the retainer is attached to the connector. Therefore, when the connector is to be installed, it is not necessary to accommodate additional component parts, and moreover, they can be mounted at the same time.

As described above, in the present invention, by moving the arm stopper into and out of the predetermined position, the removal of the connector is made possible or impossible. Therefore, there is provided the type of connector that is prevented from removal when necessary, thereby enhancing the efficiency of the operation. Particularly when the retainer and the arm stopper are mounted at the same time, the efficiency of the operation is enhanced, and furthermore, because they are integral with each other, the cost is reduced.

DETAILED DESCRIPTION OF PREFERRED EMBODIMENTS

Figure 1:
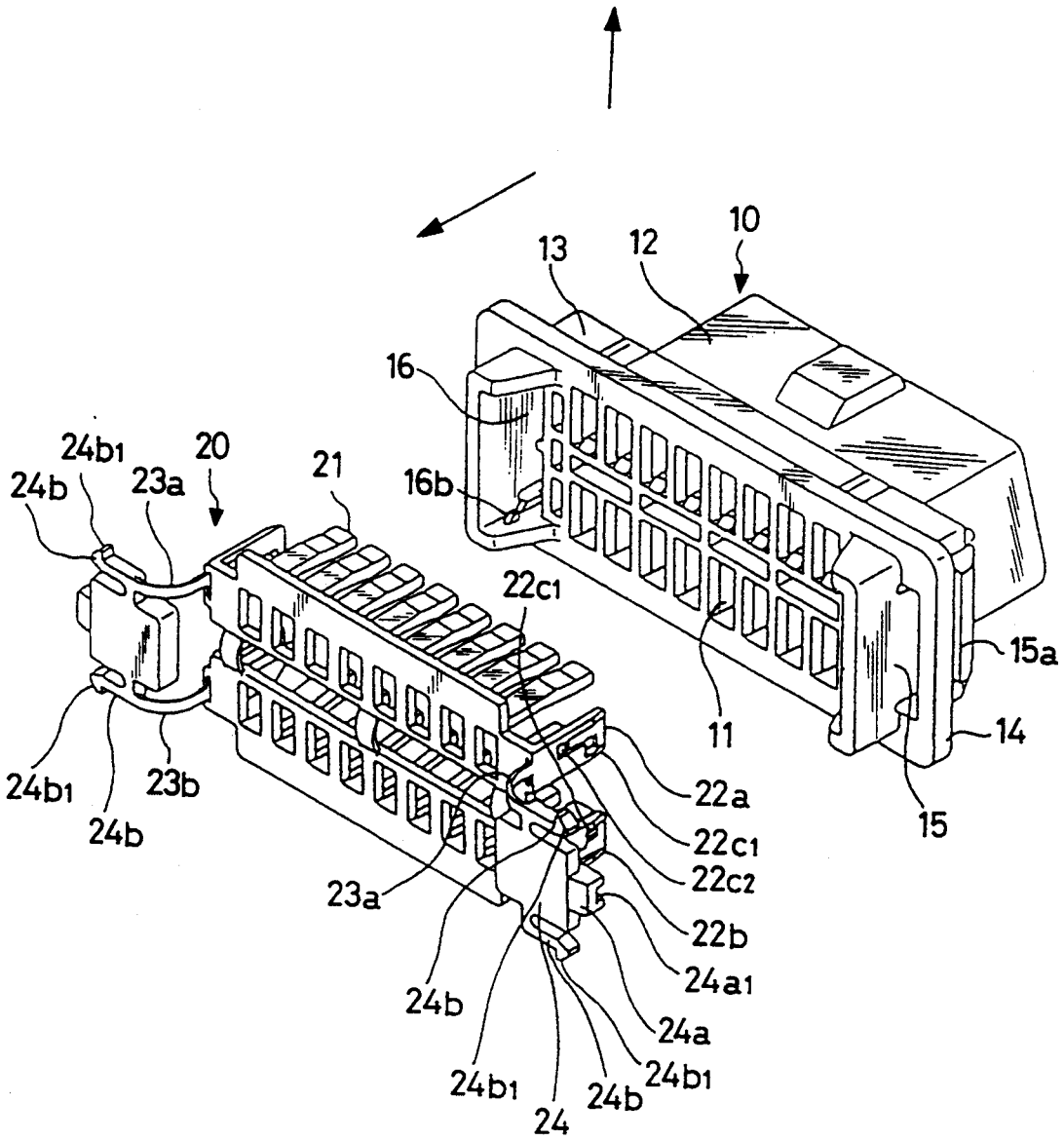
FIG. 1 is a perspective view of one preferred embodiment of a connector of the present invention.
Figure 2:
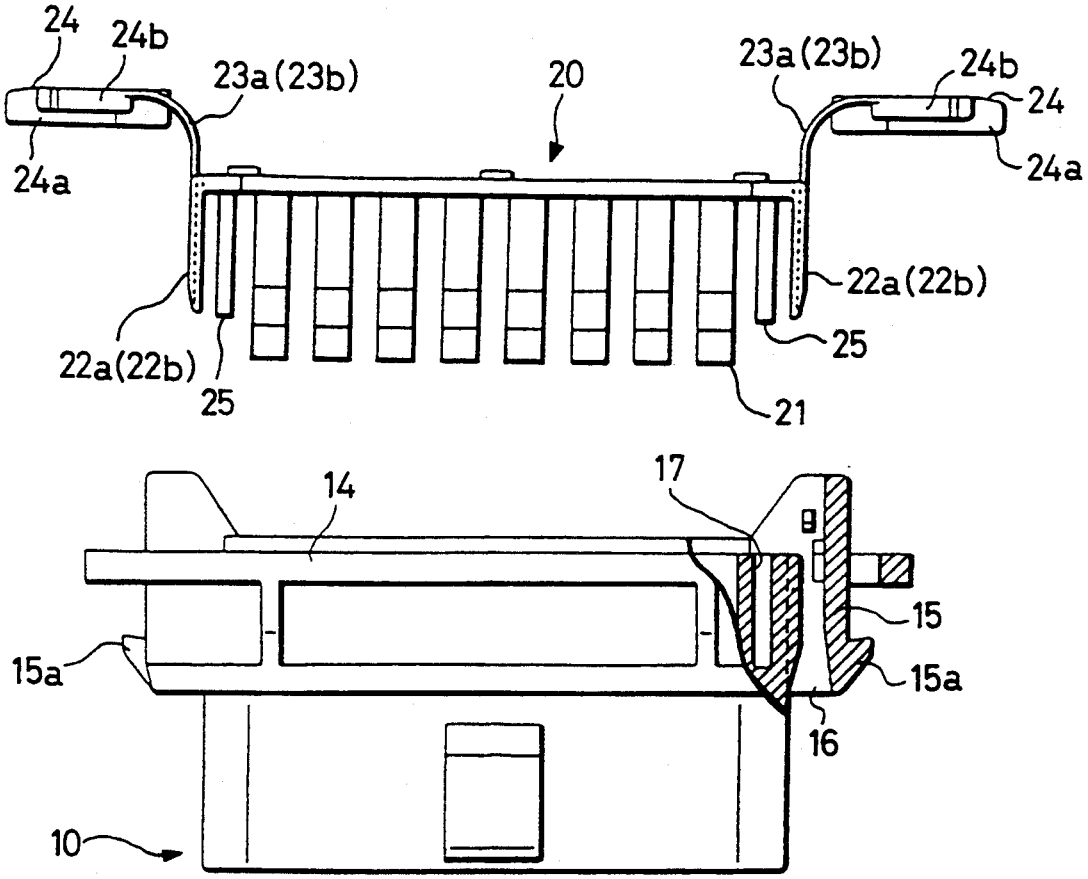
FIG. 2 is a partly-broken, front-elevational view of the connector.

FIG. 1 is a perspective view of one preferred embodiment of a connector of the present invention, and FIG. 2 is a partly-broken, top plan view thereof.

In these figures, a connector body 10 includes a rearwardly-extending body projection portion 12 having terminal receiving chambers 11 that are arranged in two rows and eight columns. A metal terminal having an electric wire clamped thereto is inserted into the terminal receiving chamber 11 from the front side thereof, and is retained there. A retainer 20 to be mated with the connector body 10 is attached to the connector body in a provisionally-retained condition before the metal terminals are inserted, and after the metal terminals are inserted, the retainer is completely retained to hold the metal terminals in a double-locked condition. A double-lock function performed by retaining pieces 21 of the retainer 20 is well known, and therefore will not be described here.

Engagement pieces 22*a* and 22*b* vertically spaced a predetermined distance from each other are formed on each of the opposite (right and left) ends of the retainer 20, and are directed toward the connector body 10. Engagement holes $22c_1$ and $22c_2$ are formed in each of the engagement pieces 22*a* and 22*b* and are spaced a predetermined distance from each other in a direction from the front to the rear. Strap-like connection portions 23*a* and 23*b* are connected at ends thereof, respectively, to the front ends of the engagement pieces 22*a* and 22*b*, and the other ends of the connection portions 23*a* and 23*b* are connected to a freely-movable arm stopper (spacer) 24 having a predetermined width. The connection portions 23*a* and 23*b* and the arm stoppers 24 are preferably formed integrally with the retainer 20.

Since the connection portions 23*a* and 23*b* are in the form of a strap, they can be bent to bring the arm stopper 24 toward the engagement pieces 22*a* and 22*b*. The arm stopper 24 has a guide projection 24*a* at its one face that is faceable to the two engagement pieces 22*a* and 22*b*. Guide projection 24*a* can be inserted into a space between the two engagement pieces 22*a* and 22*b* when the arm stopper 24 is brought into adjoining relation with the engagement pieces 22*a* and 22*b*. A groove $24a_1$ is formed in one surface of the guide projection 24*a* that is faceable to the engagement pieces 22*a* and 22*b* and extends in the direction of the length of the engagement pieces 22*a* and 22*b*. Locking arms 24*b*, which can be flexed upward and downward, are formed respectively on the upper and lower surfaces of the arm stopper 24, the upper and lower locking arms 24*b* having their respective retaining pawls $24b_1$ directed upwardly and downwardly, respectively.

Two guide pieces 25 extend from the retainer toward the connector body 10 and are disposed respectively between the left engagement pieces 22*a* and 22*b* and the retaining pieces 21 and between the right engagement pieces 22*a* and 22*b* and the retaining pieces 21.

A stepped portion 13 is formed adjacent the front side of the body projection portion 12 and is a size larger in peripheral length than the body projection portion 12, the stepped portion 13 corresponding in shape to a mounting hole 31 in a mounting panel 30. A flange 14 is formed adjacent the front side of the stepped portion 13 and is a size larger than the mounting hole 31. A locking arm 15 is formed on each of the opposite sides of the stepped portion 13 and can be flexed inwardly. An engagement hole or space 16, into which the locking arm 15 is introduced when the locking arm 15 is flexed inwardly, is provided inwardly of the side surface of the locking arm 15.

The engagement pieces 22*a* and 22*b* and the arm stopper 24 can be inserted into the engagement hole 16. There are provided projections 16*a* that can fit in the engagement holes $22c_1$ and $22c_2$ of the engagement pieces 22*a* and 22*b*. There are also provided projections 16*b* that can engage the locking arms 24*b* of the arm stoppers 24, respectively. The projection 16*a* projects outwardly from the inner side wall of the engagement hole 16. The projections 16*b* project inwardly, that is, downwardly and upwardly, from the upper and lower walls of the engagement hole 16, respectively. A ridge-like projection 16*c* is formed on the inner wall having projections 16*a* and is disposed generally centrally of the height of this inner wall, the ridge-like projection 16*c* coacting with the groove $24a_1$ formed on the arm stopper 24. The dimension of the interior of the engagement hole 16 in the widthwise direction is generally equal to the maximum thickness obtained when the arm stopper 24 is brought into adjoining relation to the engagement pieces 22*a* and 22*b*.

Provided between the engagement hole 16 and the terminal receiving chamber 11 is a guide hole 17 that guides the guide piece 25 when this guide piece is inserted.

The operation of this embodiment of the above construction will now be described.

Figure 3:
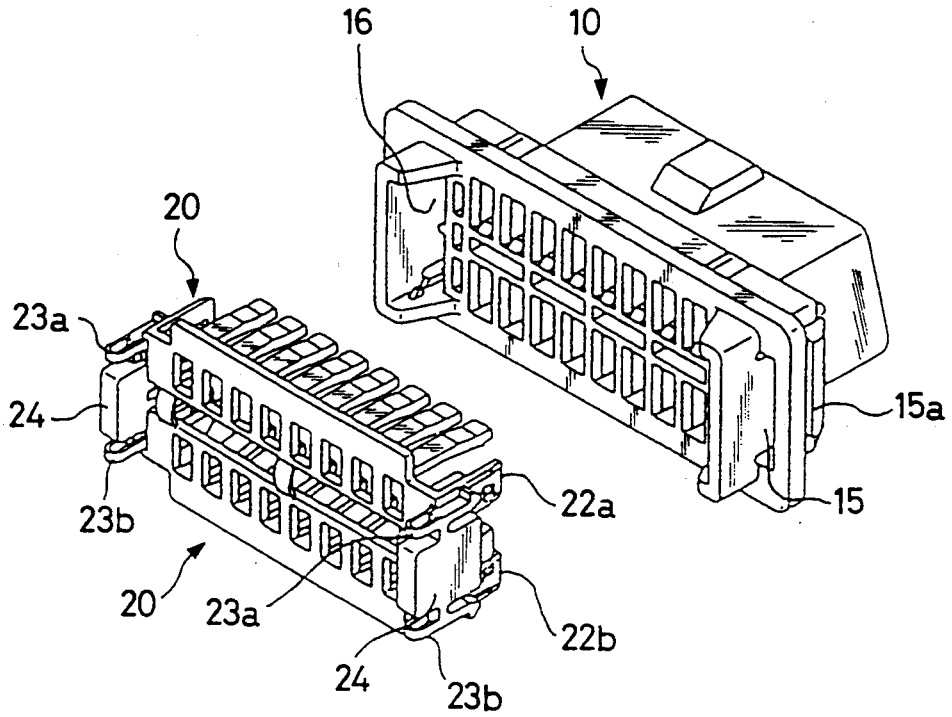
FIG. 3 is a perspective view of the connector during its assembling step.

First, as shown in FIG. 3, each arm stopper 24 is brought into adjoining relation with the engagement pieces 22*a* and 22*b*. Namely, the arm stopper 24 is moved toward the engagement pieces 22*a* and 22*b* with the strap-like connection portions 23*a* and 23*b* flexed, so that the guide projection 24*a* is received in the space between the two engagement pieces 22*a* and 22*b*.

Figure 4:
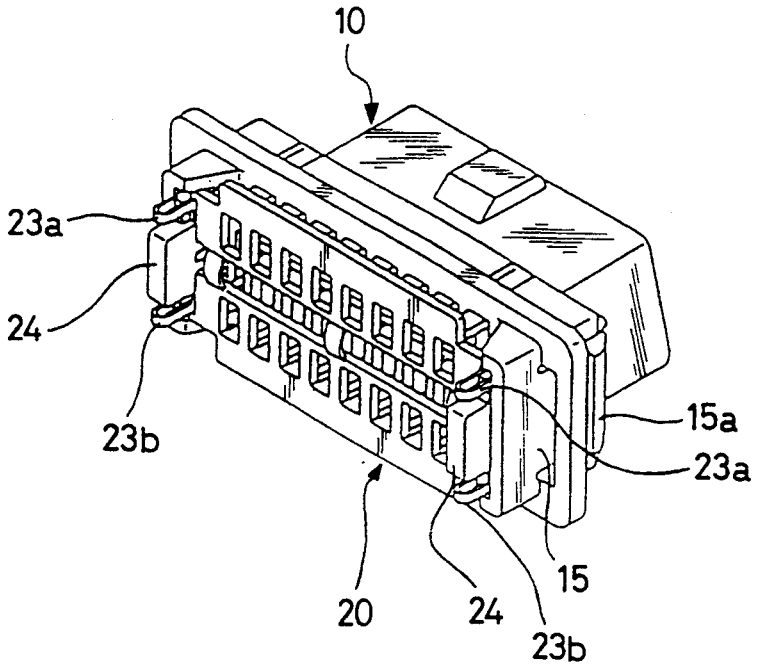
FIG. 4 is a perspective view of the connector during its assembling step.

The retainer 20 is then attached to the connector body 10 as shown in FIG. 4. More specifically, the retaining pieces 21 of the retainer 20 are inserted respectively into the terminal receiving chambers 11 of the connector body 10 from the front side of the connector body. Immediately after the retaining pieces 21 begin to be inserted, the guide pieces 25 begin to be inserted into the guide holes 17, respectively, and the retainer 20 is brought into a proper position relative to the connector body 10 by the cooperation of the guide pieces 25 with the guide holes 17.

On the other hand, almost simultaneously when the guide pieces 25 begin to be inserted into the guide holes 17, respectively, the distal ends of the engagement pieces 22*a* and 22*b* begin to be inserted into the corresponding engagement hole 16, and subsequently each arm stopper 24 also begins to be inserted into the engagement hole 16. At this time, the arm stopper is so positioned that the groove $24a_1$ in the guide projection 24*a* can be engaged with the ridge-like projection 16*c*.

As the engagement pieces 22*a* and 22*b* are inserted into the engagement hole 16, their distal ends abut respectively against the projections 16*a*, projected outwardly from the inner wall of the engagement hole 16, and slide respectively over projections 16*a*. Then, when each engagement hole $22c_1$ reaches the corresponding projection 16*a*, they are engaged with each other as shown in FIGS. 5(A) and 5(B), so that the retainer 20 and the connector body 10 are held in a provisionally-retained condition.

Figure 5A:
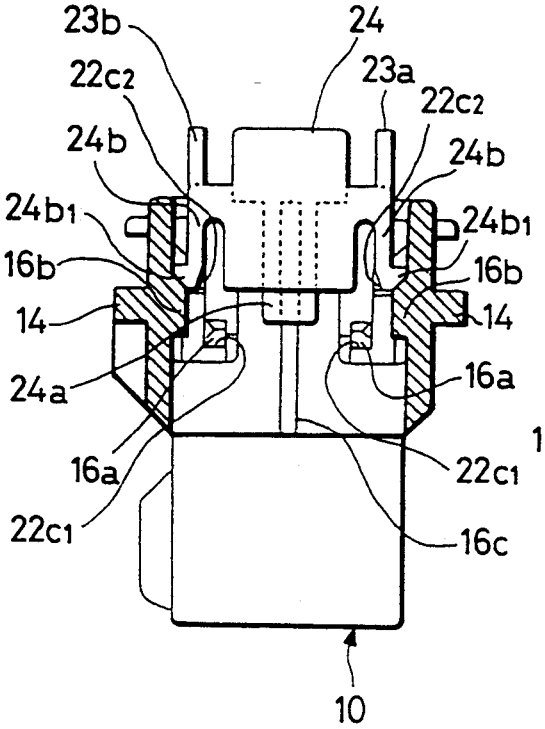
FIGS. 5(A) and (B) are vertical and horizontal cross-sectional views of the connector during the assembling step, respectively.
Figure 5B:
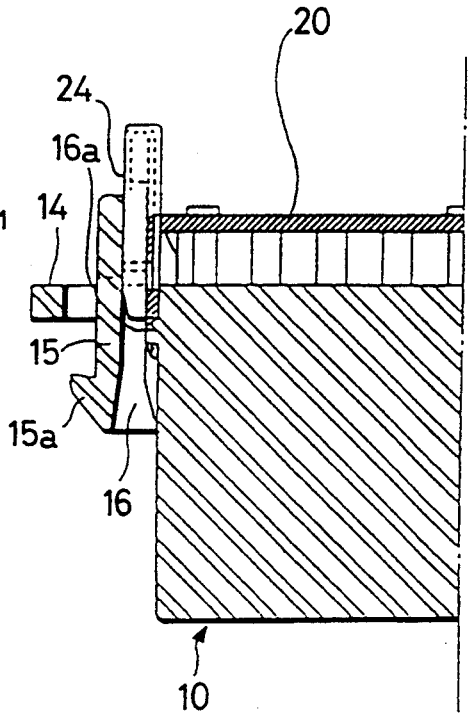

In the provisionally-retained condition, as shown in FIG. 5(A), the retaining pawls $24b_1$ of the locking arm 24*b* of the arm stopper 24 are engaged respectively with the front walls of the projections 16*b* extending inwardly respectively from the upper and lower walls of the engagement hole 16, thereby preventing the arm stopper 24 from further moving into the engagement hole 16 from this inlet portion.

Figure 6A:
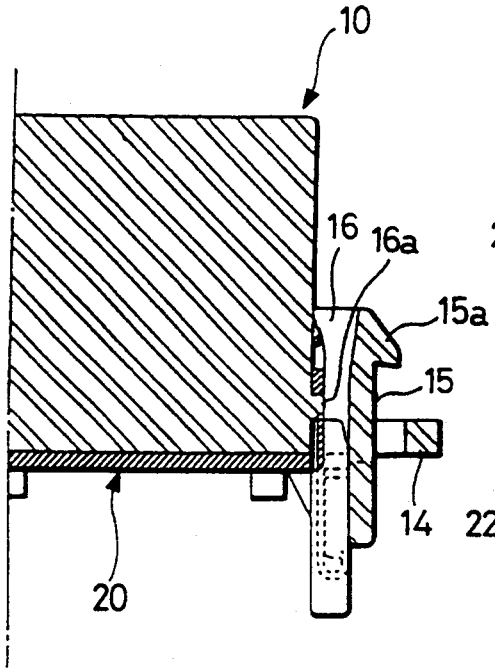
FIGS. 6(A) and (B) are vertical and horizontal cross-sectional views of the connector during the assembling step, respectively.
Figure 6B:
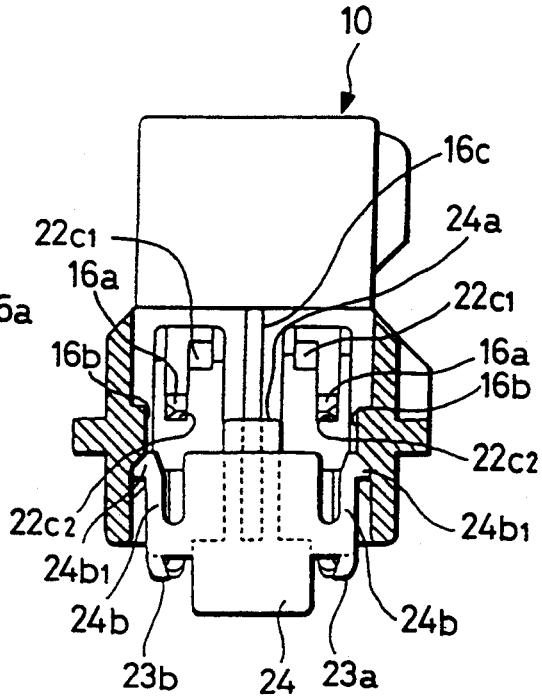

When the retainer 20 is held in the provisionally-retained condition, the metal terminals each having an electric wire clamped thereto are inserted respectively into the terminal receiving chambers 11, and the retainer 20 is forced into the connector body 10. When the retainer 20 is thus pushed in, the engagement pieces 22*a* and 22*b* advance in the engagement hole 16, and when the retainer 20 is brought generally into intimate contact with the front face of the connector body 10, the engagement holes $22c_2$ of the engagement pieces 22*a* and 22*b* reach the projections 16*a*, respectively, and are engaged with the projections 16*a*, respectively, so that the retainer 20 and the connector body 10 are held in a completely-retained condition, as shown in FIGS. 6(A) and 6(B).

Even when the retainer 20 is thus pushed in, each arm stopper 24 is held in the vicinity of the inlet portion of the engagement hole 16, as described above, and the inner portion of the engagement hole 16 provides a sufficient space so that the locking arm 15 can be flexed toward the engagement hole 16.

Figure 7:
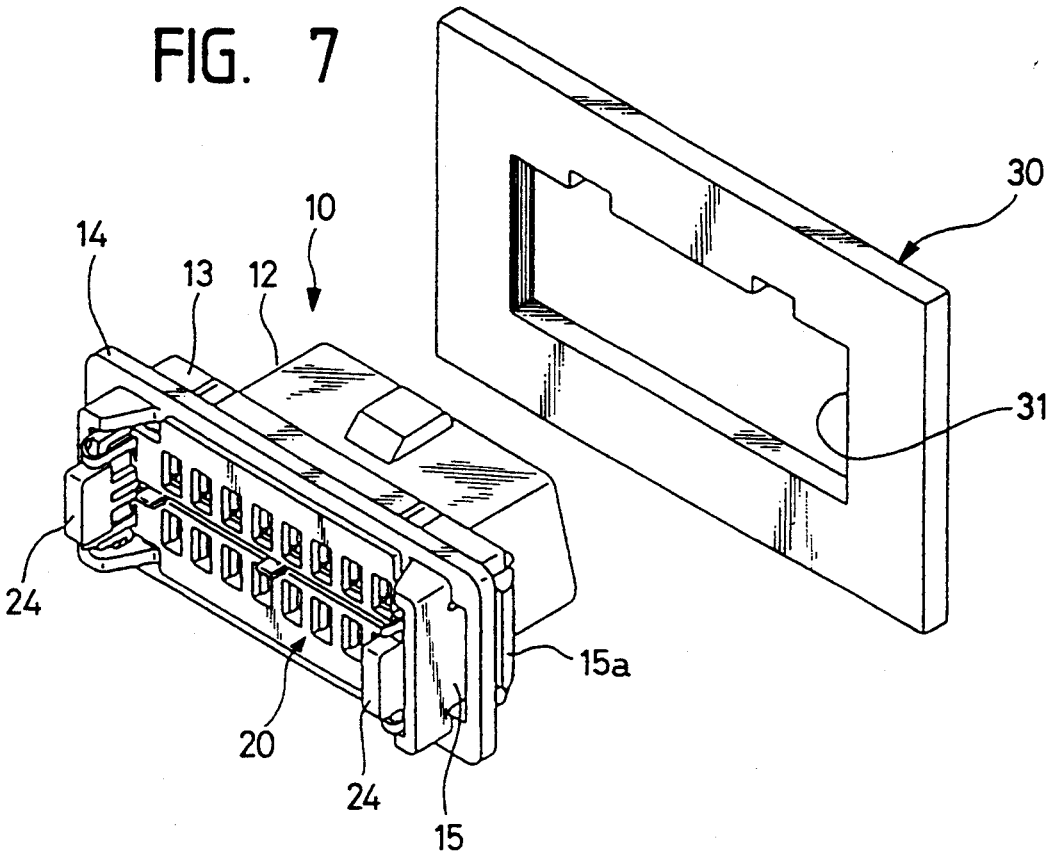
FIG. 7 is a perspective view of the connector during the assembling step.
Figure 8:
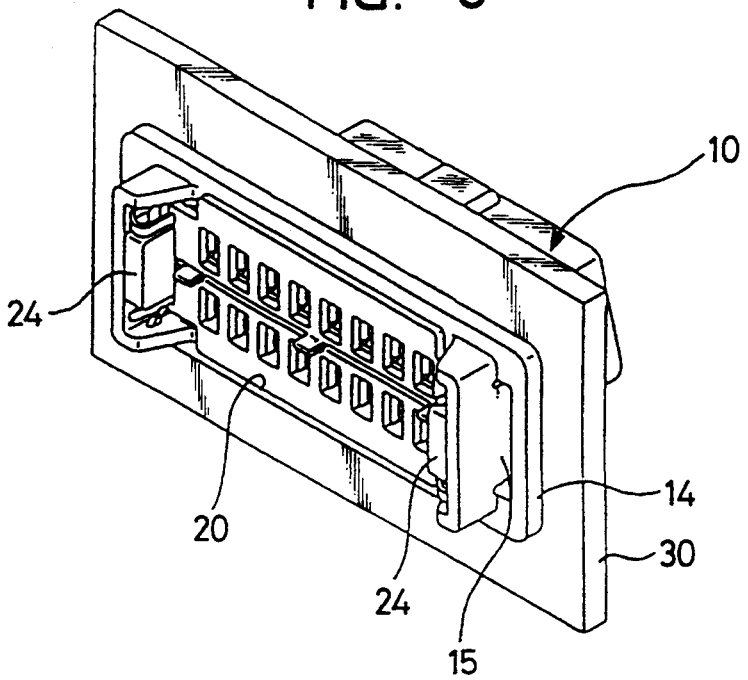
FIG. 8 is a perspective view of the connector during the assembling step.

Then, as shown in FIG. 7, the body projection portion 12 of the connector body 10 is inserted through the mounting hole 31 in the mounting panel 30. At this time, the retaining pawl 15*a* formed on the distal end of each locking arm 15 abuts against the peripheral edge of the mounting hole 31 and therefore is flexed toward the engagement hole 16. When retaining pawl 15*a* is brought to the reverse side of the mounting panel 30, the locking arm 15 is linearly restored. As a result, the retaining pawl 15*a* and the flange 14 hold the mounting panel 30 therebetween, so that the connector body 10 is retained in the mounting hole 31, as shown in FIG. 8.

Figure 9A:
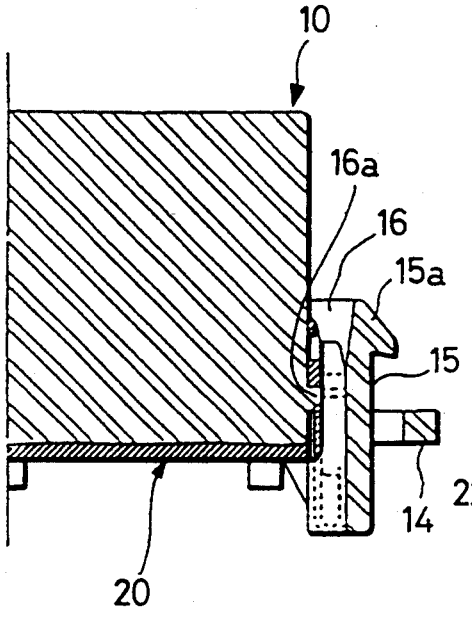
FIGS. 9(A) and (B) are vertical and horizontal cross-sectional views of the connector during the assembling step.
Figure 9B:
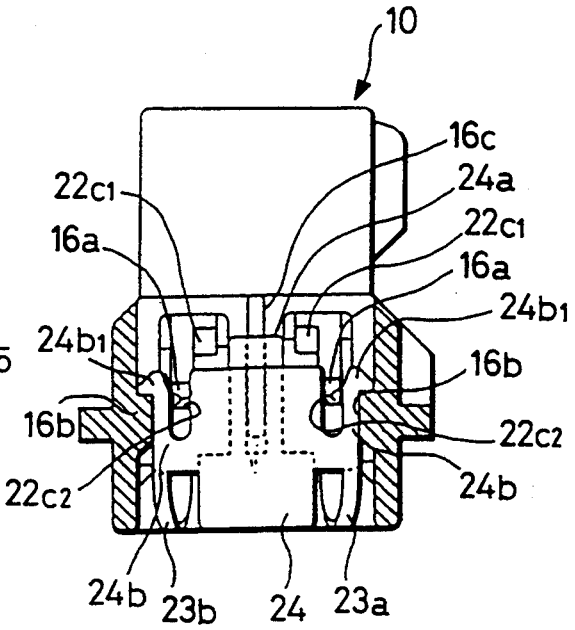
Figure 10:
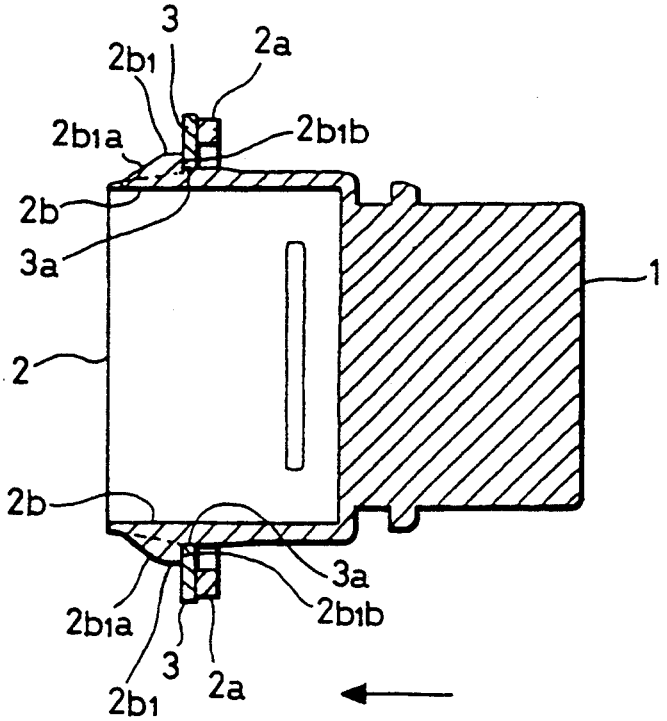
FIG. 10 (RELATED ART)
FIG. 10 is a cross-sectional view of a conventional connector in its installed condition.
Figure 11A:
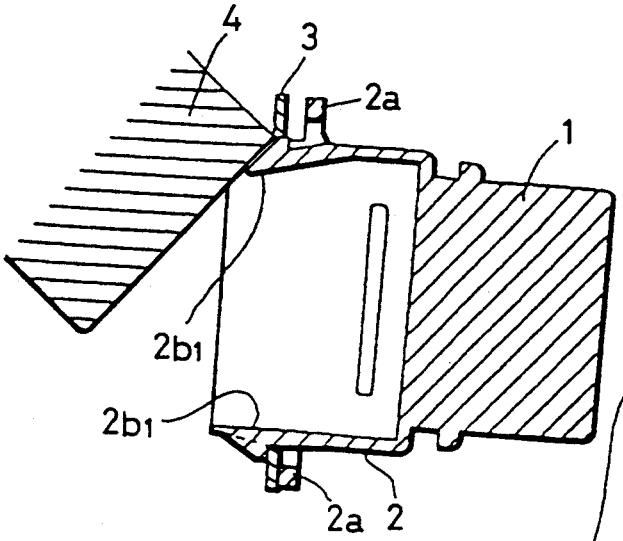
FIG. 11A (RELATED ART)
FIGS. 11(A) and (B) are cross-sectional views showing the process of disengagement of the conventional connector.
Figure 11B:
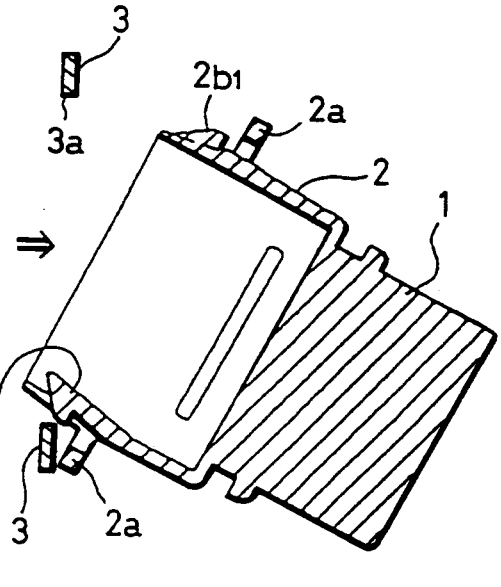
FIG. 11B (RELATED ART)

In this condition, each arm stopper 24 is further forced into the engagement hole 16. The retaining pawls $24b_1$ of the locking arms 24*b* are held respectively against the front walls of the projections 16 to thereby prevent the arm stopper from further advancing. However, by forcibly pushing the arm stopper, the locking arms 24*b* are flexed inwardly, so that the retaining pawls $24b_1$ slide over the projections 16*b*, respectively, and are brought into the inner portion of the engagement hole 16, as shown in FIGS. 9(A) and 9(B). When the arm stopper 24 is thus brought deep into the engagement hole 16, the engagement hole 16 ceases to provide a sufficient space to enable the flexing of the locking arm 15. Therefore, even if there is encountered a force tending to push the retaining pawl 15*a* inwardly, the retaining pawl 15*a* does not move since the locking arm 15 itself is not flexed, and therefore the retaining pawl is prevented from being withdrawn from the mounting hole 31.

In the above embodiment, although the arm stopper 24 is connected to the retainer by the two strap-like connection portions 23*a* and 23*b*, this connection may be done by a single connection portion, and also the strap-like configuration may be replaced by any other suitable configuration.

Although whether or not the arm stopper 24 enters deep into the engagement hole 16 prohibits or allows the flexing of the locking arm 15, the arm stopper 24 may have a recess in which the locking arm 15 may be received, and the arm stopper 24 may be movable. In this case, the position of the recess is changed by moving the arm stopper 24, and when the recess and the locking arm 15 are in registry with each other, the locking arm can be flexed, and when the recess and the locking arm 15 are out of registry with each other, flexing is prohibited. Similarly, a projection may be formed on the reverse surface of the locking arm 15, in which case an engagement hole for receiving the projection is formed in the arm stopper 24.

While the invention has been described with reference to the structure disclosed, it is not confined to the details set forth, but is intended to cover such modifications or changes as may come within the scope of the following claims.

What is claimed is:

1. A connector adapted to be inserted through a mounting hole in a fixed panel member, the connector comprising:

a connector body having a rearwardly extending body projection portion and at least one terminal receiving chamber for receiving a corresponding at least one metal terminal having an electric wire clamped thereto, said connector body further comprising at least one engagement hole having a first projection; and a retainer having at least one retaining piece and comprising means for engaging said connector body in a provisionally-retained condition before said at least one metal terminal is inserted and a completely-retained condition after said at least one metal terminal is inserted to hold said at least one metal terminal in a double-locked condition, said engaging means comprising a first engagement aperture and a second engagement aperture, wherein said first projection engages said first engagement aperture in said provisionally-retained condition and said first projection engages said second engagement aperture in said completely-retained condition.

2. A connector according to claim 1, wherein said engaging means comprises at least one engagement piece insertable in said engagement hole of said connector body, said at least one engagement piece comprising said first engagement aperture and said second engagement aperture.

3. A connector according to claim 2, wherein said engaging means further comprises at least one arm stopper having a predetermined width fixed to said at least one engagement piece by a flexible connecting portion, said at least one arm stopper comprising a guide projection and a pair of locking arms, said at least one engagement hole further comprising a pair of second projections, wherein said at least one arm stopper is insertable in said at least one engagement hole with said at least one engagement piece, said locking arms being engagable with said second projections, respectively.

4. A connector according to claim 3, wherein said engaging means further comprises at least one guide piece and said connector body further comprises at least one guide hole disposed between said at least one terminal receiving chamber and said at least one engagement hole, said at least one guide piece being insertable in said at least one guide hole.

5. A connector according to claim 4, wherein said connector body comprises two said engagement holes and said engaging means comprises two pairs of said engagement pieces on opposite ends of said retainer, one arm stopper being connected to each of said pairs of engagement pieces by said flexible connecting portion, said guide projection of said arm stoppers being received in a space between each of said pairs of engagement pieces, wherein each of said engagement holes further comprises a ridgelike projection disposed therein, said guide projection being engagable with said ridgelike projection.

6. A connector according to claim 5, wherein in said provisionally-retained condition, said locking arms engage a front wall portion of said second projections.

7. A connector according to claim 6, wherein said connector body further comprises a pair of main locking arms, and wherein in said completely-retained condition, each arm stopper is disposed in the vicinity of an inlet portion of a respective one of said engagement holes, such that said main locking arms can be flexed toward the engagement holes.

8. A connector according to claim 7, wherein said retainer is engagable with said connector body in a double-locked condition, and wherein in said double-locked condition, said connector is inserted through said mounting hole in said fixed panel, said locking arms engage a rear wall portion of said second projections, and each arm stopper is disposed in a respective one of said engagement holes, respectively, such that said main locking arms are prevented from being flexed toward the engagement holes.

9. A connector according to claim 3, wherein in said provisionally-retained condition, said locking arms engage a front wall portion of said second projections.

* * * * *